US005299641A

United States Patent [19]

Paulo et al.

[11] Patent Number: 5,299,641

[45] Date of Patent: Apr. 5, 1994

[54] CHRISTMAS TREE FOR SUBSEA PRODUCTION

[75] Inventors: Cezar A. S. Paulo; José Eduardo M. Silva, both of Rio de Janeiro, Brazil

[73] Assignee: Petróleo Brasileiro S.A.-Petrobrás, Rio de Janeiro, Brazil

[21] Appl. No.: 925,640

[22] Filed: Aug. 7, 1992

[30] Foreign Application Priority Data

Aug. 9, 1991 [BR] Brazil ..... PI 9103428

[51] Int. Cl.[5] ..... E21B 43/013

[52] U.S. Cl. ..... 166/341; 166/347; 166/368

[58] Field of Search ..... 166/339, 341, 342, 345, 166/357, 368

[56] References Cited

U.S. PATENT DOCUMENTS 3,163,224 12/1964 Haeber et al. ..... 166/345
3,215,203 11/1965 Sizer ..... 166/345
3,870,101 3/1975 Helmus ..... 166/368
4,625,806 12/1986 Silcox ..... 166/368
4,629,003 12/1986 Baugh ..... 166/341
4,630,680 12/1986 Elkins ..... 166/368

*Primary Examiner*—Ramon S. Britts
*Assistant Examiner*—Frank S. Tsay
*Attorney, Agent, or Firm*—Sughrue, Mion, Zinn, Macpeak & Seas

[57] ABSTRACT

This invention refers to a wet Christmas tree (20) utilized particularly in subsea production systems, including at the bottom a connector (22) for purposes of locking to the wellhead, a guide structure (24) consisting of a central ring attached to said connector (22), supporting arms (26) and guide funnels (28), a valve block (30), a reentry mandrel (32), gate-type lateral valves (46, 48, 50, 52) with metal/metal sealing and hydraulic driving with spring-type return flow lines with loops (54, 56, 58) and piping for the crossover line, hydraulically adjustable chokes (60, 62), a flow line terminal (36), a reentry pole (42) and a control system.

10 Claims, 3 Drawing Sheets

CHRISTMAS TREE FOR SUBSEA PRODUCTION

FIELD OF THE INVENTION

This invention refers to a Christmas tree, which is particularly useful for application in a subsea petroleum production system, which presents a largely simplified and more reliable manifold.

STATE OF THE ART

The subsea production systems for petroleum originating from wells located at large depths utilize subsea completion, since such option is the most feasible, both technically and economically.

Among the subsea production systems is the template-manifold which includes, among other components, a template structure, a manifold and Christmas trees. The subsea production systems known so far present, as their major characteristic, the provision, either in the template-manifold or in the manifold, of active elements, such as chokes, maneuver valves and control modules. This leads to both an increased number of recoverable modules and a reduced system reliability.

OBJECT OF THE INVENTION

With the purpose of reducing the number of recoverable modules arranged in a template-manifold of a subsea production system, thus improving the reliability of the system, this invention refers to a Christmas tree having as its major characteristic the inclusion, in same, of active elements such as chokes, maneuver valves and control modules, thus simplifying the template-manifold of the subsea production system.

DESCRIPTION OF THE INVENTION

This invention refers to a Christmas tree for utilization in subsea production systems of the type described in the application for patent BR PI 9005123, of the same Applicant.

The objects of this invention include:

- a lower connector for locking to the wellhead;
- a guide structure consisting of a central ring attached to said connector, arms for support and guide funnels;
- a valve block, prepared, at the top, to receive a reentry mandrel and, at the bottom, for coupling to said connector or to a spacing spool;
- an upper reentry mandrel;
- a protection cap;
- gate-type lateral valves with metal/metal sealing and hydraulic drive with spring-type return;
- flow lines with loops and piping for crossover lines;
- hydraulically adjustable chokes;
- a flow line terminal;
- a reentry pole; and
- a control module, preferably of electrohydraulic multiplexed type.

DETAILED DESCRIPTION OF THE INVENTION

More specifically, the Christmas tree of this invention includes: at the bottom, a connector for locking to the wellhead; a guide structure consisting of a central ring attached to the connector, arms for support of guide funnels and guide funnels with portholes for guide cable passage; a valve block prepared, at the top, to receive the reentry mandrel and, at the bottom, for coupling to the connector or to a spacing spool; a reentry mandrel prepared, at the top, to receive the Christmas tree running tool, a tree cap, a secondary unlocking tool of the Christmas tree connector and a handling tool; a tree cap; lateral valves for the production line, production testing, annulus line and crossover; flow lines consisting of loops for the crossover line which connects the annulus and production lines; chokes incorporated to the WCT arrangement; a flow line terminal with the purpose of making possible to connect the flow lines (production, production testing and annulus) and the hydraulic control lines between the Christmas tree and the manifold; a reentry pole integrated to the assembly of the Christmas tree with orientation key; and a control system responsible for the activation of WCT functions during the installation and operation phases.

DETAILED DESCRIPTION OF THE PREFERRED EMBODIMENT

Figure 1:
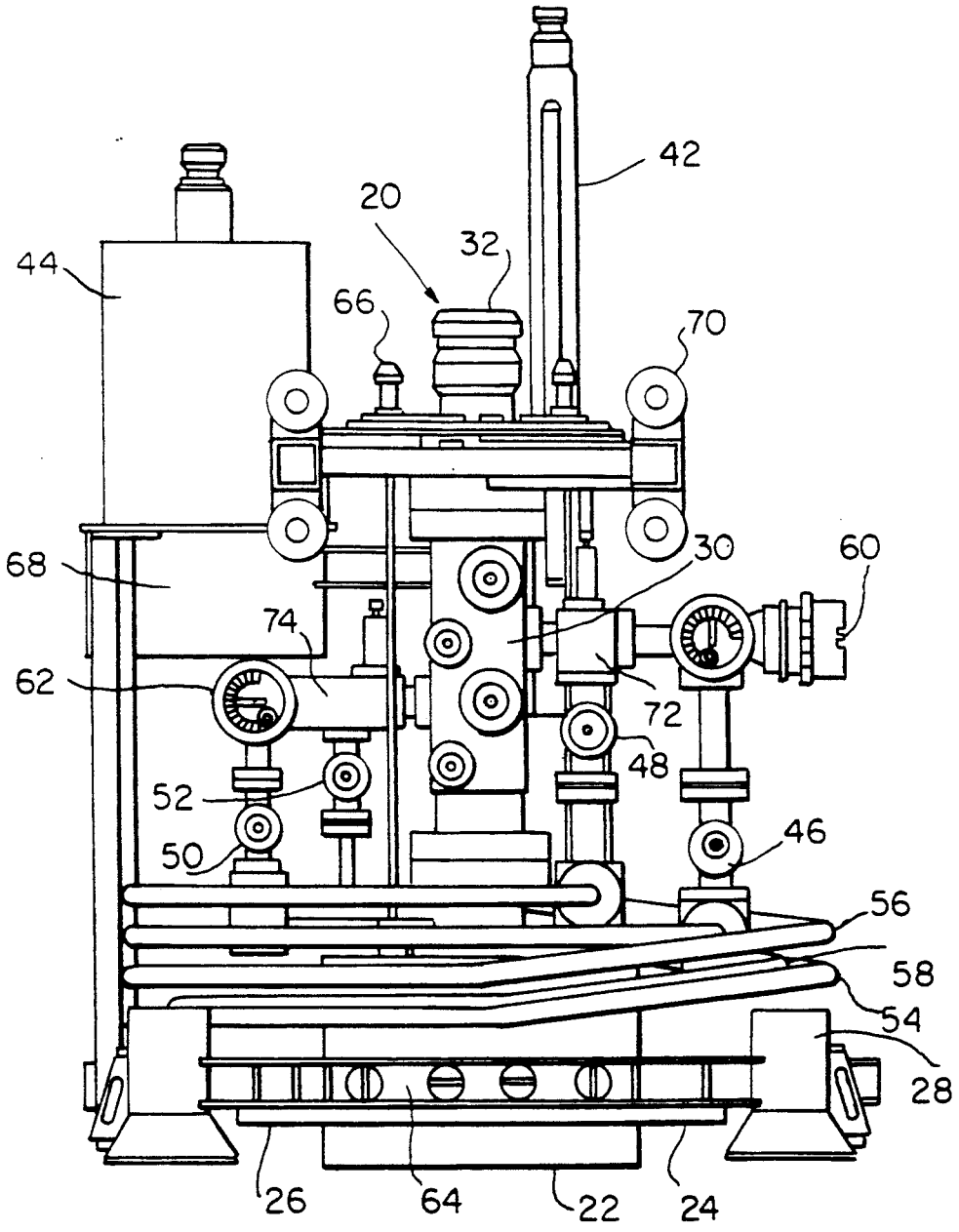
FIG. 1 is a front view of the Christmas tree, object of this invention.
Figure 2:
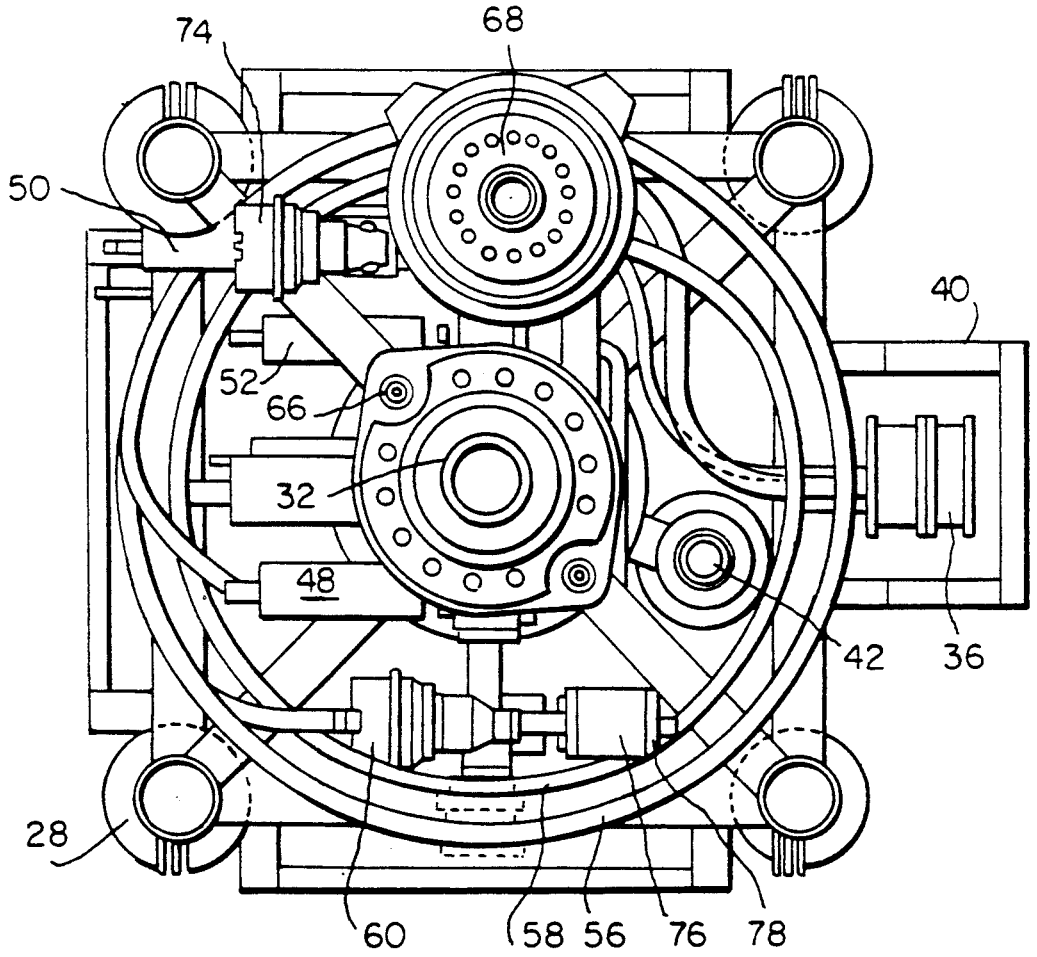
FIG. 2 is an overview of the Christmas tree.
Figure 3:
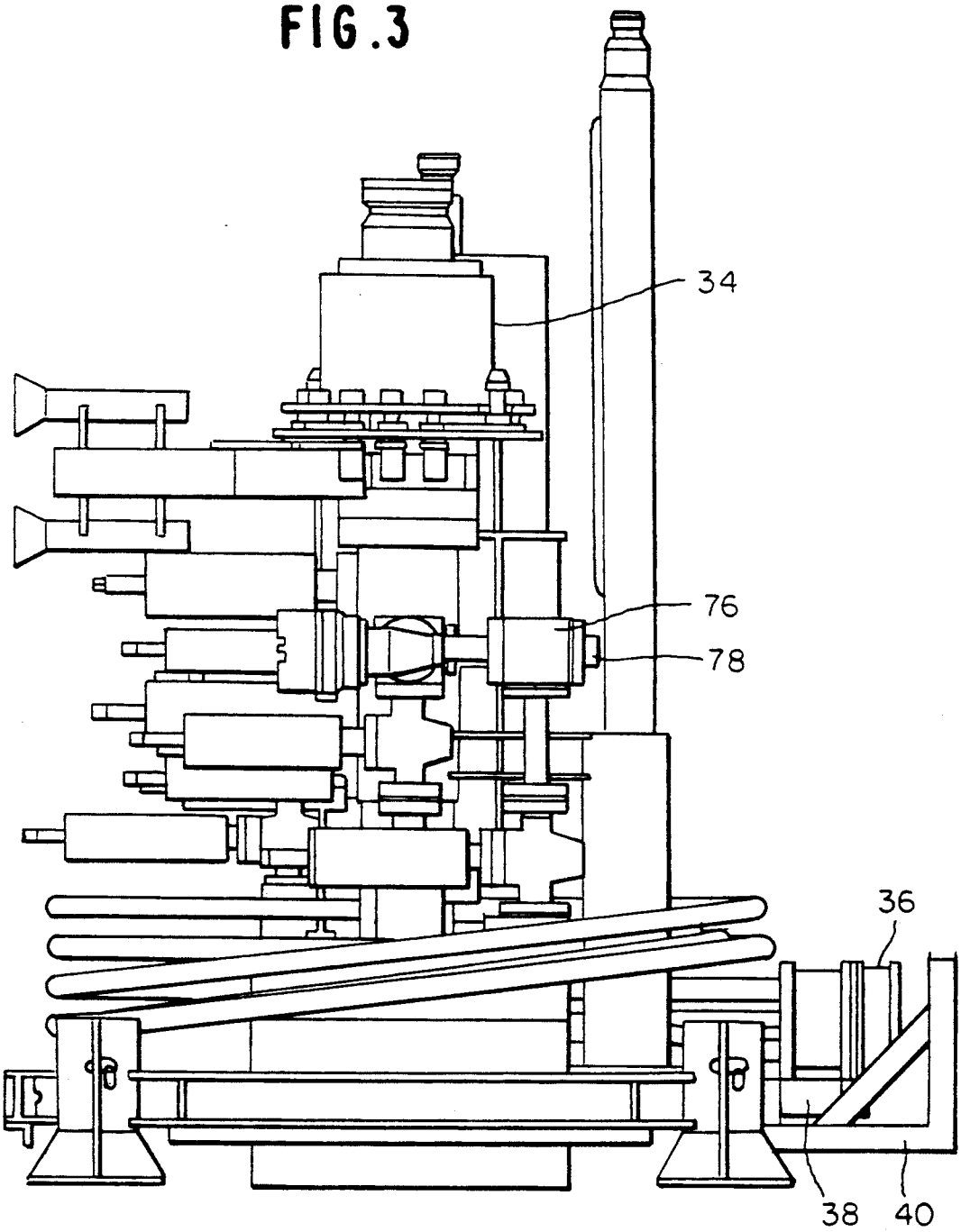
FIG. 3 is a lateral view of the Christmas tree.

As it may be inferred from FIGS. 1 through 3, in which the same numerical references identify corresponding parts, the Christmas tree referred to in the Figures in general by the numerical reference 20, includes at the bottom a connector 22 for locking to the wellhead with a visual indicator of locked/unlocked position and secondary unlocking mechanism with an extension up to the top of the WCT for driving by means of a tool to be run with a drill string. A guide structure 24 is provided, consisting of a central ring attached to the connector 22, arms 26 for support of and guide funnels 28 with portholes for guide cable passage. A valve block 30 prepared, at the top, to receive a reentry mandrel 32 and, at the bottom, for coupling to the connector 22 or to a spacing spool. The reentry mandrel 32 is, prepared, at the top, to receive a Christmas tree running tool, a tree cap, a tool for secondary unlocking of the connector 22 and a handling tool, and, at the bottom, for assembly to the block 30, extension of the vertical passages of access to the production and to the annulus and connectors of the hydraulic lines for the installation tool and for a WCT cap 34. The tree cap 34 of blank type and being pressure tight for the passages, works as a second protection barrier during the production. It is installed, preferably, by the same Christmas tree installation tool. Gate-type lateral valves with metal/metal sealing and hydraulic driving with spring-type return, usually closed are provided; along with flow lines with loops having flexibility compatible with the course required by the connection system and piping for a crossover line. Hydraulically adjustable chokes are incorporated into the Christmas tree arrangement. A flow line terminal 36 consisting basically includes a terminal itself, of the device 38 for retraction of the loops and unlocking of the terminal and a protection structure 40 (to prevent damages to the terminal during the transportation and handling operations, and which is to be run prior to running the Christmas tree. A reentry pole 42 provided with orientation key has the purpose of guiding and orienting the Christmas tree or tree installation tool, the tool for secondary unlocking of the connector and the installation tool of a control module 44. A control module 44 constitutes a assembly responsible for the activation of the Christmas tree functions during the installation and operation phases, and is preferably of the electrohydraulic multiplexed type.

The valve block 30 includes a vertical passage for production, with two gate-type valves (one master and one for swabbing), presenting metal/metal sealing and hydraulic driving with spring-type return, usually closed, equipped with override mechanism for ROV tool driving, and lateral accesses to the two control lines of a secondary system and subsurface safety valve (SCSSV), provided with isolating valves prepared for ROV operation.

The lateral valves previously mentioned include valves 46, 48 for the production line and the testing and production line, and valves 50, 52 for the annulus and crossover line, equipped with an override mechanism for ROV tool driving.

The flow lines consist of loops 54, 56 for the production and production testing lines, and a loop 58 for the annulus line, with a flange extremity for assembly at the outlet of the valve block 30 (or in flow crosspiece), and another bevelled extremity for welding to the flow line terminal 36, and also of piping for the crossover line, making the connection between the annulus and production lines.

Chokes are incorporated into the arrangement of the WCT 20 including a choke 60 for the production line and a choke 62 assembled on the annulus line (for lift gas control). The choke 60 should have the upstream and downstream flanges equidistant in relation to the body centerlines, so as to allow for the choke assembly in an inverted position (for assembly in either production or injection trees).

As it can be also seen on the figures, that the Christmas tree 20 includes a panel of ROV operated valves 64, pins 66 for secondary unlocking of the connector, a base 68 for control module, a structure 70 for ROV anchoring, crosspieces 72, 74 and 76, and an impact flange 78.

It must be pointed out that the valves 46, 48, for the production and production testing lines, and the valves 50, 52, for the annulus and crossover line, have their actuators oriented towards the external face of the template-manifold and are equipped with interface for secondary ROV operation. In addition, the Christmas tree 20 can be converted from production to water injection through the mere inversion of the choke 60 for the production line, with allowance for the utilization, in the Christmas tree 20, of a control system of electrohydraulic multiplexed type.

It must be pointed out also that the wet Christmas tree with the characteristics of this invention can be used both in the structure of the template-manifold and in the structure of the manifold.

We claim:

1. CHRISTMAS tree for subsea production comprising: a connector (22) for locking said Christmas tree to a wellhead; a guide structure (24) consisting of a central ring attached to said connector (22), supporting arms (26) and guide funnels (28) carried by said guide structure; a valve block (30) coupled at a top thereof, to a reentry mandrel (32), and including at a bottom thereof, means for coupling said valve block to said connector (22) or to a spacing spool; a protection cap (34); first two and second two gate-type lateral access valves (46, 48, 50, 52) having metal/metal sealing means and means for hydraulic driving said lateral valves and, spring-type return means; flow lines including loops (54, 56, 58) coupled to said first two gate-type lateral access valves (46, 48) and piping forming a crossover line; hydraulically adjustable chokes (60, 62) coupled to said valve block (36); a flow line terminal (36) coupled to said flow lines; a reentry pole (42): and a control module (44), of an electrohydraulic multiplexed type mounted above said guide structure.

2. CHRISTMAS tree, according to claim 1, wherein said reentry mandrel (32) includes a means at a top thereof, for receiving a WCT running tool, said protection cap (34), a tool for secondary unlocking of said connector (22) and a handling tool, and means at a bottom thereof for assembly to said valve block (30), and extension of the vertical passages for access to the production and to an annulus and connectors of the hydraulic lines for the installation tool and for said protection cap (34).

3. CHRISTMAS tree, according to claim 1, wherein said valve block (30) includes vertical passages for production and access to said first two and second two lateral access gate-type valves.

4. CHRISTMAS tree, according to claim 3, wherein said first two and second two lateral access valves comprise respectively, valves (46, 48) respectively for the production and production testing lines, and valves (50, 52) respectively, for annulus line and crossover line, and said valves being equipped with an override mechanism for ROV tool operation.

5. CHRISTMAS tree, according to claim 1, wherein said loops comprise respectively, a production loop (54) and a production testing loop (56), and a loop (58) for an annulus line having a flange extremity assembled to the outlet of said valve block (30) and another bevelled extremity welded to said flow line terminal (36).

6. CHRISTMAS tree, according to claim 1, wherein said chokes comprising respectively, a first choke (60) for the production line, and a second choke (62) assembled on an annulus line, and said first choke (60) having upstream and downstream flanges equidistant in relation to a centerline of a choke body, thus allowing its assembly in an inverted position for operation in both production and injection modes.

7. CHRISTMAS tree, according to claim 1, wherein said flow line terminal (36) includes a device (38) for retraction of said loops (54, 56, 58) and means for locking of said terminal (36), and a protection structure (40).

8. CHRISTMAS tree, according to claim 1, wherein said connector (22) is equipped with secondary unlocking mechanism with extension up to the top of the WCT (20) for operation by tool to be run with drill string, and with said tool actuating pins (66).

9. CHRISTMAS tree, according to claim 1, wherein said first two and second two valves (46, 48, 50, 52 and 64) have actuators oriented towards the external face of the template-manifold and being equipped with an interface for ROV operation.

10. CHRISTMAS tree, according to claim 1, wherein said WCT (20) is convertible from production to water injection by inversion of said first choke (60).

* * * * *